US008760055B2

(12) United States Patent
Pacquet et al.

(10) Patent No.: US 8,760,055 B2
(45) Date of Patent: Jun. 24, 2014

(54) ELECTRON CYCLOTRON RESONANCE ION GENERATOR

(75) Inventors: Jean-Yves Pacquet, Herouville Saint Clair (FR); Gabriel Gaubert, Caen (FR)

(73) Assignees: Commissariat a l'energie atomique et aux energies alternatives, Paris (FR); Centre National de la Recherche Scientifique, Paris Cedex (FR)

( * ) Notice: Subject to any disclaimer, the term of this patent is extended or adjusted under 35 U.S.C. 154(b) by 462 days.

(21) Appl. No.: 13/002,105

(22) PCT Filed: Jun. 11, 2009

(86) PCT No.: PCT/FR2009/051104

§ 371 (c)(1),
(2), (4) Date: May 23, 2011

(87) PCT Pub. No.: WO2010/001036

PCT Pub. Date: Jan. 7, 2010

(65) Prior Publication Data

US 2011/0210668 A1 Sep. 1, 2011

(30) Foreign Application Priority Data

Jul. 2, 2008 (FR) ..... 08 54502

(51) Int. Cl.
*H01J 27/18* (2006.01)

(52) U.S. Cl.
USPC ..... 315/111.81; 315/500; 315/502; 315/505

(58) Field of Classification Search
USPC ..... 315/502, 500, 505, 111.81
See application file for complete search history.

(56) References Cited

U.S. PATENT DOCUMENTS 4,780,642 A * 10/1988 Jacquot ..... 313/359.1
4,933,650 A 6/1990 Okamoto

FOREIGN PATENT DOCUMENTS

EP 0 344 969 12/1989
EP 0 514 255 11/1992
EP 0 946 961 10/1999

OTHER PUBLICATIONS

Kato et al., Electron Cyclotron Resonance Multicharged Ion Source With Elemental Boron, 1994, Review of Scientific Instruments, pp. 1113-1115.*
Hill, Ion and Electron Sources, 1996, CERN European Organization for Nuclear Research Reports—CERN, pp. 95-111.*

(Continued)

*Primary Examiner* — Alexander H Taningco
*Assistant Examiner* — David Lotter
(74) *Attorney, Agent, or Firm* — Pillsbury Winthrop Shaw Pittman LLP

(57) ABSTRACT

An electron cyclotron resonance ion generator includes a vacuum-tight chamber configured to contain a plasma, a magnetic field generator configured to generate a magnetic field in the chamber, a waveguide configured to propagate a high-frequency wave inside the chamber, a first ionization stage located at one end of the chamber, the first stage including an ionization zone in which ions are generated, the magnetic field being approximately parallel to a longitudinal axis in the ionization zone, a second magnetic confinement stage for the ions generated in the ionization zone, the second stage using a first high-frequency wave being propagated in the chamber from the waveguide, the magnetic field being approximately parallel to the longitudinal axis between the ionization zone and the second confinement stage, such that the ions generated in the ionization zone migrate towards the second confinement stage and the first and second stages contain the same continuous plasma.

13 Claims, 4 Drawing Sheets

(56) References Cited

OTHER PUBLICATIONS

Loew et al., Design of a High Temperature Oven for an ECR Source for the Production of Uranium Ion Beams, 2007, Proceedings of PAC07, pp. 1742-1744.*

Stadler et al., Design of an All-Permanent-Magent, Volume-Type, 10GHz ECR Ion Source With Field-FormingIron Yoke, CP749, Electron Cyclotron Resonance IOn Sources—16th International Workshop on ECR Ion Sources, pp. 199-201.*

Alton, G.D., "Broadband frequency ECR ion source concepts with large resonant plasma volumes", Nuclear Instruments and Methods in Physics Research A, vol. 382, 1996, pp. 276-282.

International Search Report as issued for PCT/FR2009/051104, dated Dec. 22, 2009.

* cited by examiner

ELECTRON CYCLOTRON RESONANCE ION GENERATOR

CROSS-REFERENCE TO RELATED APPLICATIONS

This is the U.S. National Stage of PCT/FR2009/051104, filed Jun. 11, 2009, which in turn claims priority to French Patent Application No. 0854502, filed Jul. 2, 2008, the entire contents of all applications are incorporated herein by reference in their entireties.

The present invention relates to an electron cyclotron resonance ion generator.

As is known, electron cyclotron resonance sources, so-called ECR sources, are commonly used to produce mono-charged or multi-charged ions (i.e. atoms from which one or more electrons have been removed).

The principle of these ECR sources is to couple, inside a vacuum-tight chamber supplied with atoms (these atoms can originate from a gas or a metal), a high-frequency wave with a B magnetic field, in such a way as to obtain the conditions under which a cyclotron resonance is capable of appearing and ionising the atoms present, thus generating a plasma. The residual pressure prevailing in the vacuum-tight chamber is of the order of $10^{-6}$ to $10^{-1}$ Pa.

Generally, the chamber containing the plasma has a symmetry of revolution with respect to a longitudinal axis. The magnetic field is produced by means external to the vacuum-tight chamber. These means can be constituted by a set of coils through which an electric current or a set of permanent magnets runs. The coils employed, if they are constituted by superconductive materials, must be cooled to a given temperature by a suitable cryogenic system.

The cyclotron resonance is obtained thanks to the combined action of the high-frequency wave injected into the chamber and a magnetic field having a so-called "minimum B" structure. The magnetic field has in particular a modulus Br which satisfies the electron cyclotron resonance condition (1):

$$Br=f\cdot 2\Pi m/e \quad (1)$$

wherein e represents the charge of the electron, m its mass and f the frequency of the electromagnetic wave.

An ion extraction system, located at the side of the chamber opposite that of the injection of the high frequency, or disposed laterally with respect to the axis of the source opposite the plasma, is also provided.

With this type of source, the quantity of ions capable of being produced results from the competition between two processes: on the one hand, the formation of the ions by electron impact on neutral atoms constituting the gaseous medium to be ionised, and on the other hand the losses of these same ions by recombination with the neutral or charged particles present in the plasma volume or by diffusion of the neutral atoms up to the walls of the chamber.

Provision is made to confine in the chamber the ions formed as well as the electrons used for their ionisation. This is achieved by superimposing on the magnetic field with an axial symmetry a magnetic field with a radial symmetry. This radial magnetic field is obtained with the aid of a multipolar structure generally constituted by permanent magnets. A positive field gradient is created in all directions (along the axis and towards the wall of the chamber) and is a decelerator. The electrons of the plasma are trapped axially and radially in a magnetic potential well. This magnetic mirror configuration is obviously not perfect (leakage lines) and this is taken advantage of in order to extract the charged particles which will form the beam at the exit of the plasma electrode.

The superposition of the radial magnetic field and the axial magnetic field leads to the formation of closed equimodulus surfaces of the magnetic field which do not have any contact with the walls of the chamber. The total magnetic field is controlled in such a way that there is at least one completely closed magnetic surface on which the electron cyclotron resonance condition (1) is satisfied.

Patent EP946961 filed by the applicant describes an ECR source employing a magnetic field with a symmetry of revolution. This source comprises magnetic means, whereof the vector sum of the fields created by these magnetic means makes it possible to define at least one closed line of minima of the B modulus of the vector sum, inside one or more volume(s) inside the cavity and delimited by equimodulus surfaces Bf of the magnetic field which are closed in space. The closed surface of modulus $B_f$ encompasses an interior volume where the magnetic field can, in particular, have a very low minimum B, in contrast with what is produced with the already known ECR sources.

The electron density of the plasmas of the ECR sources is between $10^9$ and $10^{12}$ electrons per $cm^3$. These neutral particles are injected into the volume of the vacuum-tight chamber containing the plasma. If they are not ionised during their first passage within the plasma, they stick to the walls of the chamber. Their sticking time depends on the chemical species to which they belong. This time can be very long for particles whose physical-chemical properties permit a reaction with the walls. Their probability of ionisation therefore depends directly on the ionisation capacity of the plasma.

Ionisation efficiencies close to 100% can be observed for gases not reacting with the walls. The successive rebounds of the particles on the walls multiply the number of passages of the particles in the plasma and permit their ionisation if they are not ionised when passing through the most intense electron excitation zones of the plasma (around the resonance zones).

In contrast, the same does not hold true for condensable elements (Pb, Ge for example) of the Mendeleyev periodic table. The latter, if they are not ionised during the first passage in the plasma, become stuck to the walls as soon as they reach the latter and can only become unstuck therefrom if the temperature of the wall is sufficient for the element of interest. Conventional ECR ion sources with cold walls therefore lead to low overall ionisation efficiencies, to the extent that the atoms that are not ionised during their first passage in the plasma are condensed on the walls of the chamber and are lost for the production of the beam. Thus, taking account of the efficient ionisation sections by electron impact, the ionisation efficiencies for condensable elements are several per thousand for a frequency wave of 2.45 GHz up to 20% for a frequency wave of 15 GHz.

It should be noted that the same holds true for the production of radioactive ions, the efficiency whereof will be very much dependent on the lifetime of these elements.

For gases not reacting with the wall, the ionisation efficiency is evidently higher than for condensable elements; however, in parallel, the total transformation time of neutral particles increases, this time being linked at the same time to the various rebounds and the unsticking time of the particles.

In this context, the aim of the present invention is to provide an electron cyclotron resonance ion generator that permits the direct ionisation capacity to be increased before any rebound on the walls of the vacuum-tight chamber.

For this purpose, the invention proposes a device being an electron cyclotron resonance ion generator comprising:

a vacuum-tight chamber intended to contain a plasma, said chamber having an axial symmetry along a longitudinal axis, means for generating a magnetic field in said chamber, said magnetic field having a symmetry of revolution with respect to said longitudinal axis, means for propagating a high-frequency wave inside said chamber, said device being characterised in that said chamber comprises:

a first ionisation stage located at one end of said chamber, said first stage comprising an ionisation zone in which ions are generated, said magnetic field being approximately parallel to said longitudinal axis in said ionisation zone, a second magnetic confinement stage for said ions generated in said ionisation zone, said second stage using a first high-frequency wave being propagated in said chamber from said means for propagating a high-frequency wave, said magnetic field being approximately parallel to said longitudinal axis between said ionisation zone and said second confinement stage, such that the ions generated in said ionisation zone migrate towards said second confinement stage and that said first and second stages contain the same continuous plasma.

A magnetic field having a symmetry of revolution with respect to the longitudinal axis is understood to mean a magnetic field whose radial and axial components are symmetrical whatever the points situated on a circle around said axis.

Thanks to the invention, the time for transformation of neutral particles into ions is reduced, thereby ensuring a high ionisation efficiency. The device according to the invention has a magnetic field with symmetry of revolution defining the volume of a continuous plasma contained in a chamber comprising two separate zones or stages. The ions are essentially created in the first zone, whilst the second zone ensures the confinement of the ions according to the principle of the electron cyclotron resonance source. Between these two zones, the directions of the vectors of the magnetic field are parallel to the axis common to both stages, i.e. the longitudinal axis of the chamber: there is therefore a purely axial magnetic field between these two zones (no radial component of the magnetic field). The two zones do not exhibit any rupture in magnetic terms and define a volume containing one and the same plasma, i.e. one and the same whole comprising ions, electrons, atoms and molecules, overall electrically neutral (i.e. with as many positive charges as negative charges). The fact of using coaxial magnetic field vectors between the two stages implicitly means that the magnetic field has a symmetry of revolution and imposes the migration of the ions from the first zone towards the second zone.

In the first zone, the ionisation efficiency for a particle depends on the means used to perform this ionisation. The ionised particles migrate towards the second ECR stage in which they are confined, or indeed multi-charged; it will be noted in this regard that the second stage can preserve or increase the state of charge of the ions coming from the first stage.

The ions confined by the second stage can therefore be used in the form of a beam of mono-charged or multi-charged particles. The beam thus produced will exhibit the characteristics given by an ECR type of source having a symmetry of rotation, such as described in the applicant's patent EP946961.

Concerning the ionisation of particles having a short lifetime (radioactive atoms, unstable molecules, . . . ), the device according to the invention permits an increase in the probability of ionising the latter before they have changed state by reducing the temperature required for the transformation process.

Moreover, the parallelism between said magnetic field and the longitudinal axis is determined by the Larmor radius of the ion of interest (radius of gyration of the ion around the field lines). Thus, the radius of gyration increases with the mass of the ions of interest. To the extent that, according to the invention, the particles ionised in the ionisation zone have to migrate towards the confinement zone, the requirement for parallelism of the magnetic field with the axis will depend on the Larmor radius of this ion. It can easily be seen that, for an ion of interest of low mass, it will be possible to tolerate a greater lack of parallelism between the magnetic field and the longitudinal axis than for an ion of interest of higher mass with an increased Larmor radius and which could, for a magnetic field having too great an angle with the longitudinal axis, depart from the intended direction and not migrate towards the second stage. Generally speaking, it can be said that the maximum angle $\theta$ between the magnetic field vectors located in the ionisation zone and between this ionisation zone and the entry of the confinement zone must remain less than 30°. It will be noted that it is possible to reduce the Larmor radius of the ion of interest by having an increased magnetic field modulus in the ionisation zone.

The device according to the invention can also have one or more of the following features, considered individually or in any technically possible combinations:

Said first ionisation stage is an electron cyclotron resonance ion source;

The device according to the invention comprises a waveguide for the injection of a second high-frequency wave into said ionisation zone;

The device according to the invention comprises a system for injecting the elements to be ionised disposed in the vicinity of the resonance zone forming said ionisation zone of said cyclotron resonance ion source, said system remaining outside said resonance zone;

Said injection system is a furnace injecting the vapour of condensable elements to be ionised into said resonance zone;

Said first ionisation stage is selected among the following sources:

discharge source, surface ionisation source, thermal ionisation source,

Laser source, field ionisation source, charge exchange source,

The device according to the invention comprises means for locally increasing the modulus of the magnetic field in said ionisation zone;

said means for locally increasing the modulus of the magnetic field are formed by a soft-iron ring;

said means for generating a magnetic field in said chamber comprise permanent magnets, the axis of revolution whereof coincides approximately with said longitudinal axis;

said means for generating a magnetic field in said chamber comprise at least one coil, through which a current of given intensity passes, said coil being produced with a superconductive material or a conventional material;

The device according to the invention comprises an extraction zone for said ions which is located at the end opposite that in which said first ionisation stage is located, said magnetic field being approximately parallel to said longitudinal axis in said extraction zone;

said means for generating a magnetic field in said chamber make it possible to define in said second magnetic confinement stage at least one closed line of minima of said magnetic field, inside one or more volume(s) inside said chamber and delimited by equimodulus surfaces of the magnetic field which are closed in space.

Other features and advantages of the invention emerge clearly from the description which is given below, by way of indication and on no account limiting, by reference to the appended figures, in which.

Figure 1:
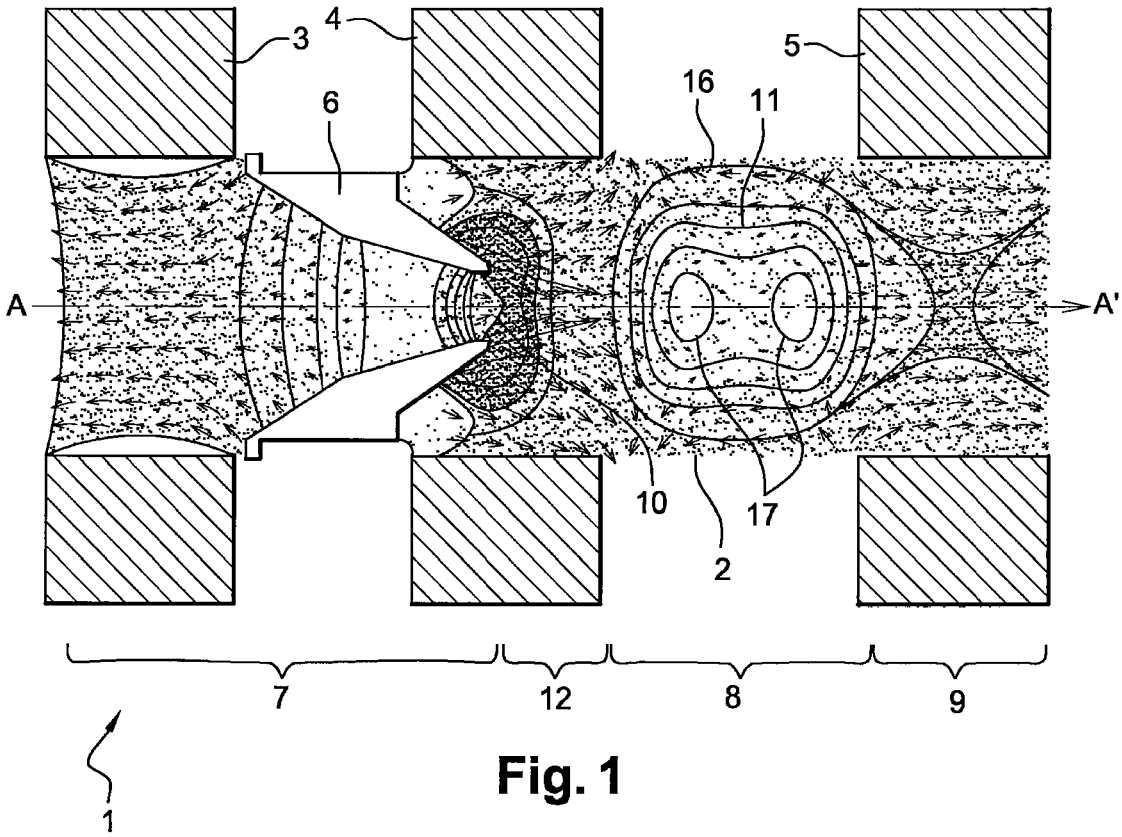
FIG. 1 is a simplified schematic representation of the device according to a first embodiment of the invention including a chart of intensities of the modulus, equimodulus lines and vectors of the electromagnetic field prevailing in the device according to the invention.
Figure 3:
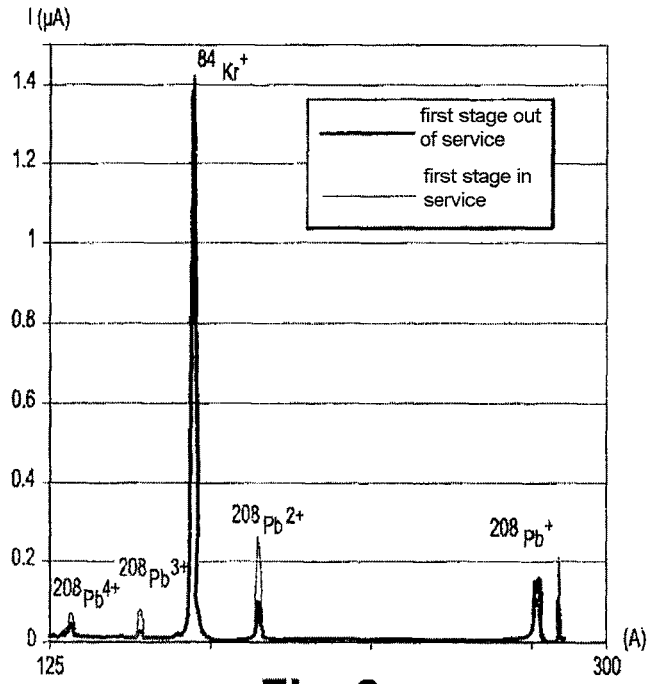
Figure 4:
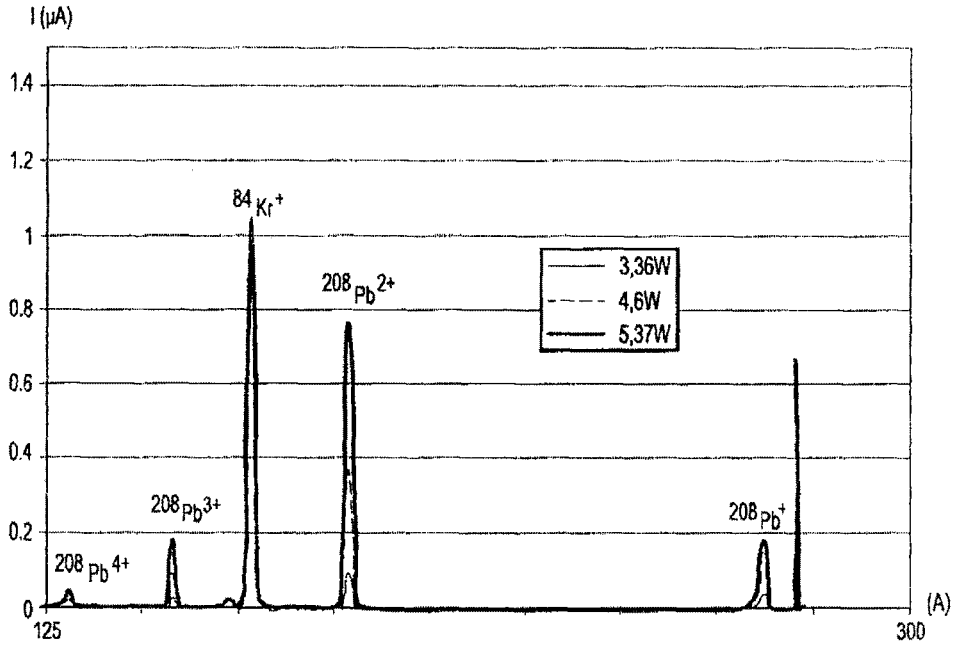
Figure 5:
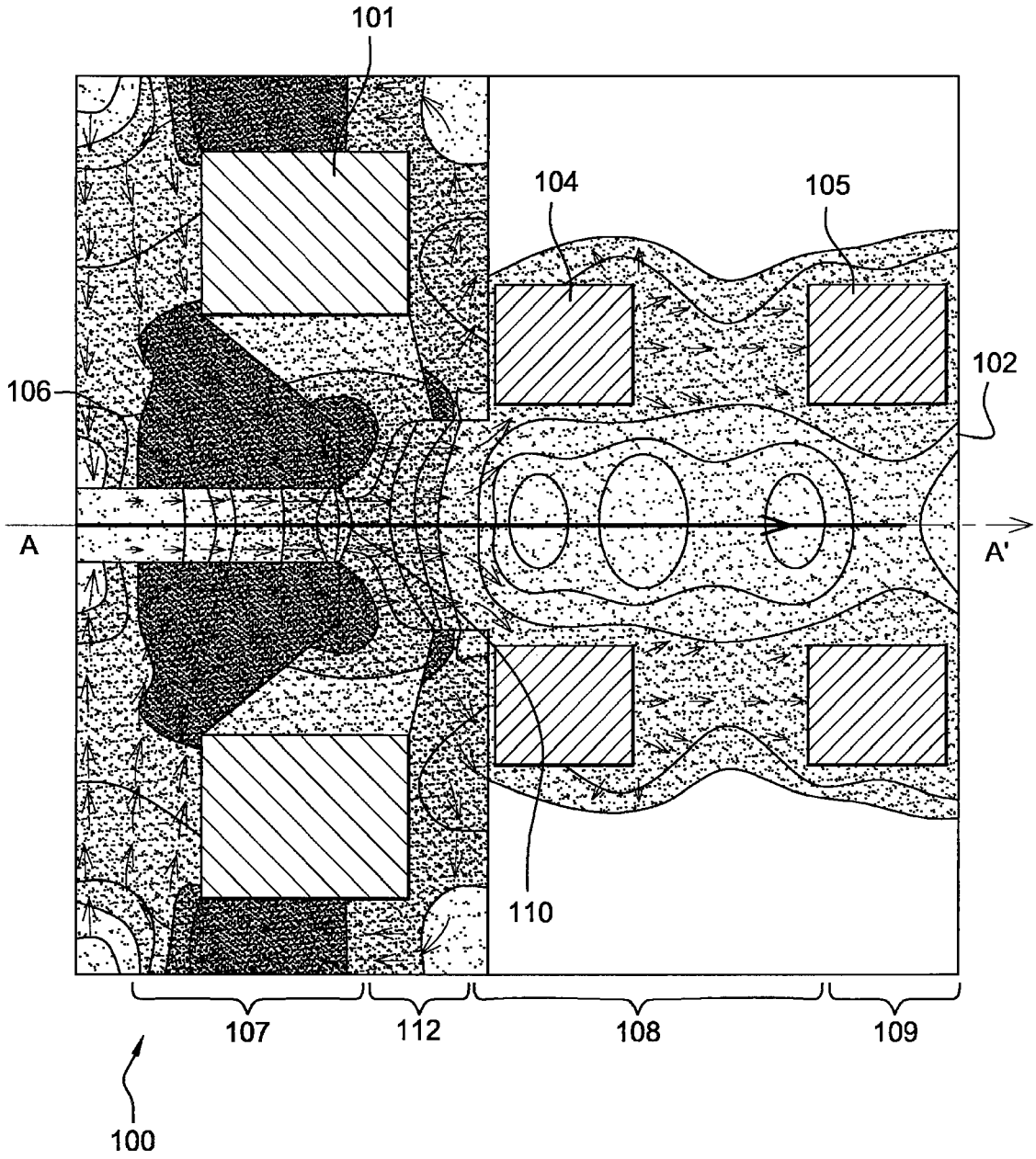
Figure 6:
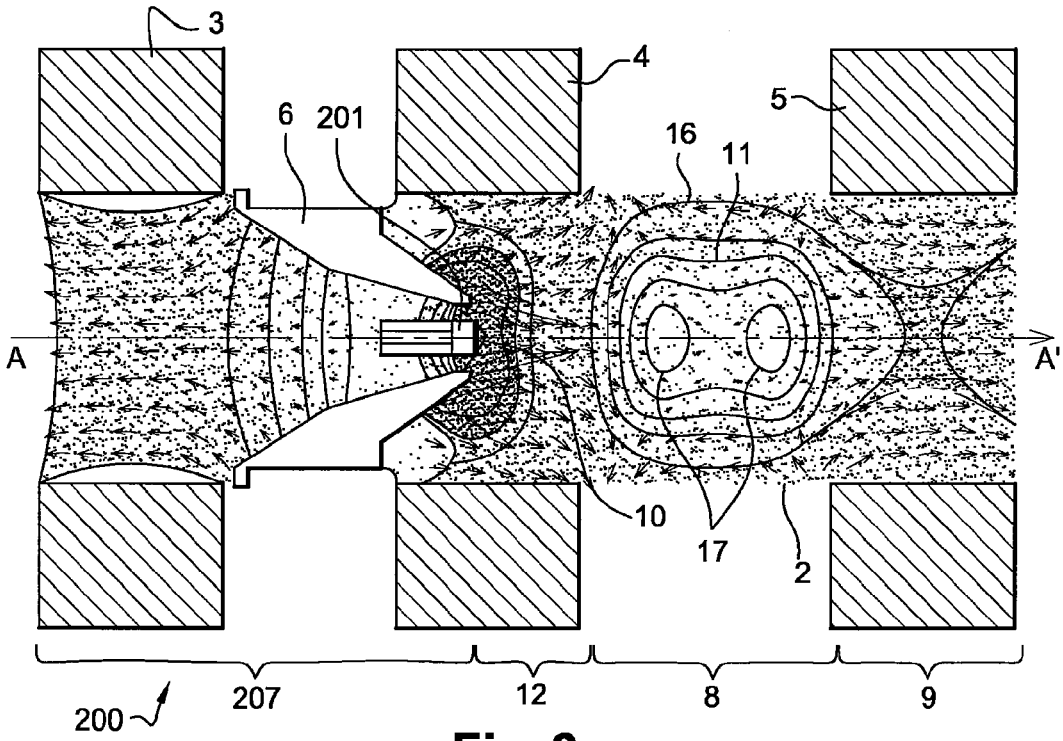
Figure 7:
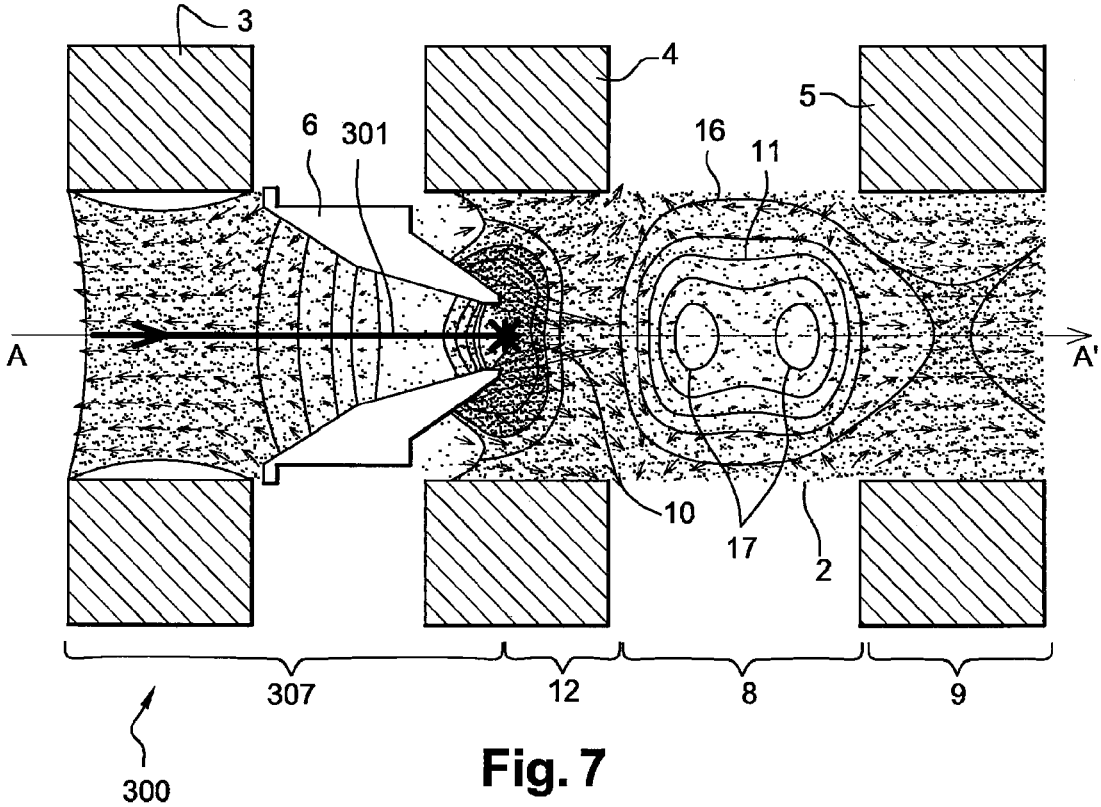

FIG. 3 gives two spectra of multi-charged ions respectively with and without the functioning of the first stage of the device of FIG. 1;

FIG. 4 gives three spectra of multi-charged ions respectively with three different heating powers of the micro-furnace used to inject the neutral particles into the first stage of the device of FIG. 1;

FIG. 5 is a simplified schematic representation of the device according to a second embodiment of the invention including a chart of intensities of the modulus, equimodulus lines and vectors of the electromagnetic field prevailing in the device according to the invention;

FIG. 6 is a simplified schematic representation of the device according to a third embodiment of the invention including a device being a thermo-ionisation ion generator, a chart of intensities of the modulus, equimodulus lines and vectors of the electromagnetic field prevailing in the device according to the invention;

FIG. 7 is a simplified schematic representation of the device according to a fourth embodiment of the invention including a device being a laser-excitation ion generator, a chart of intensities of the modulus, equimodulus lines and vectors of the electromagnetic field prevailing in the device according to the invention.

In all the figures, the common elements have the same reference numbers.

Figure 2:
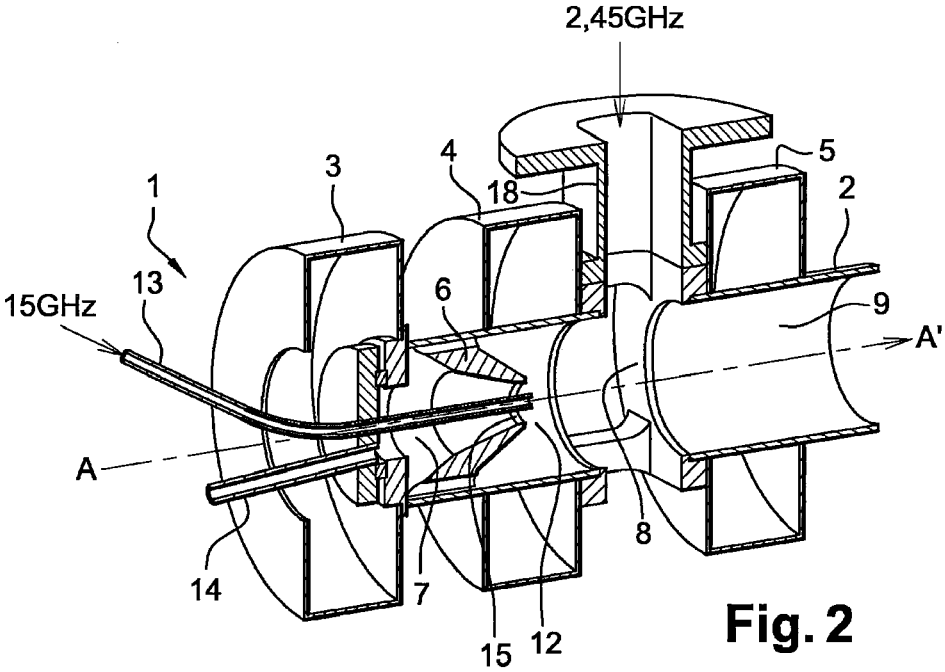
FIG. 2 is a three-dimensional view of the mechanical configuration of the device of FIG. 1.

FIG. 1 is a simplified schematic representation of a device 1 according to a first embodiment of the invention. It will be noted that some mechanical elements represented in FIG. 2 are not represented in the outline diagram of FIG. 1 in order to permit a better understanding of this figure. FIG. 2 is a three-dimensional view of the mechanical configuration of the device of FIG. 1 (for a better understanding of device 1, FIG. 2 represents a cross-section in a vertical plane passing through the longitudinal axis of device 1).

Device 1 comprises:

a vacuum-tight chamber 2 having a longitudinal axis of symmetry AA';

three permanent magnets 3, 4 and 5 essentially identical, having an annular shape and being disposed beside one another in such a way that their axis of revolution essentially coincides with longitudinal axis AA' of chamber 2, magnet 3 being located at a first end of device 1, magnet 5 at the opposite end and magnet 4 being located between magnet 3 and magnet 5;

a soft-metal conical element 6 disposed in such a way that its narrowed cross-sectional end is located inside intermediate magnet 4.

Permanent magnets 3, 4 and 5 can be monobloc magnets or magnets comprising several sectors assembled with a magnetisation in the same direction.

FIG. 1 also includes a chart of the intensity of the modules, equimodulus lines and vectors of the electromagnetic field prevailing in device 1 according to the invention.

Thus, the intensity of the modulus of the magnetic field is represented by dots: the denser the dots, the more intense the modulus prevailing in chamber 2.

Similarly, several equimodulus surfaces are represented in FIG. 1 by continuous lines.

Finally, the magnetic field vectors are represented by arrows.

Device 1 comprises:

a first ionisation stage 7 located at one end of chamber 2, first stage 7 comprising an ionisation zone 10;

a second magnetic confinement stage 8 for the ions generated by first stage 7;

an ion migration zone 12 from first stage 7 towards second stage 8;

an ion extraction zone 9, this zone being able to be lateral located in zone 8.

Here, ionisation zone 10 is an ECR zone (it will be noted that the systems for injecting ions and the high-frequency wave are not represented in FIG. 1). This ECR zone 10 is typically a high-density zone with a resonance zone functioning at 15 GHz (value given purely by way of indication for a waveguide permitting a wave of frequency between 8 GHz and 18 GHz to be carried). It will be noted that this is provided solely for the ionisation of the injected neutral particles and not for the confinement of these same ionised particles. This resonance frequency at 15 GHz implies the presence of a magnetic field with a modulus approximately equal to 5300 G in order to provide the phenomenon of resonance that will permit the efficient ionisation of the neutral particles (acquisition of mono-charged and multi-charged ions). The configuration of the magnetic field of the first stage is provided by magnets 3 and 4 as well as by soft-iron conical element 6. The soft-iron conical element makes it possible locally to increase the value of the magnetic field modulus in order to obtain the resonance magnetic field in ionisation zone 10. As represented in FIG. 2, the high-frequency wave at 15 GHz is transmitted via a waveguide 13 in such a way that the high-frequency wave at 15 GHz is injected at resonance zone 10.

Device 1 also comprises a tube 14 into which a micro-furnace (not represented) is inserted: this micro-furnace makes it possible, by heating a compound to be ionised until a sufficient vapour pressure, to produce condensable elements of the Mendeleyev periodic table (Pb for example). The micro-furnace is also placed approximately along longitudinal axis AA' and must be very close to resonance zone 10 but without penetrating into this zone. Typically, the micro-furnace can be positioned set back 2 mm (see location illustrated by reference 15) from the end of waveguide 13: this furnace is loaded for example with $^{208}$Pb. It should be noted that the ionisation of a condensable element is a fundamental criterion for qualifying the device according to the invention, since condensable elements not ionised during the first passage in the known devices become stuck to the walls as soon as they reach the latter and can only become unstuck therefrom if the temperature of the wall is sufficient for the element of interest.

The ions produced by first stage 7 in ionisation zone 10 are taken over by the magnetic field approximately parallel to the longitudinal axis AA' (i.e. the radial component of the magnetic field is essentially zero) at one and the same time in ionisation zone 10, then between ionisation zone 10 and the entry of the second confinement stage, in such a way that the ions generated in said ionisation zone migrate spontaneously by rolling around the field lines towards said second confinement stage 8 (it will be noted that all of the ions, mono- and multi-charged, are taken over and migrate towards second stage 8). It will also be noted that the fact that a magnetic field approximately colinear with axis AA' is imposed in fact implies having a magnetic field with a symmetry of rotation. As already mentioned above, the parallelism between the magnetic field and longitudinal axis AA' is determined by the Larmor radius of the ion of interest. Thus, the Larmor radius increases with the mass of the ions of interest (the radius of gyration of Ar is therefore smaller than the radius of gyration of Pb, which is heavier than Ar). To the extent that, according to the invention, the particles ionised in ionisation zone 10 must migrate towards second confinement stage 8, the requirement for parallelism of the magnetic field with the axis will depend on the Larmor radius of this ion. It can easily be seen that, for an ion of interest of low mass, it will be possible to tolerate a greater lack of parallelism between the magnetic field and the longitudinal axis than for an ion of interest of greater mass with a large Larmor radius and which could, for a magnetic field having too great an angle with longitudinal axis AA', depart from the intended direction and not migrate towards second stage 8. Generally speaking, it can be said that the maximum angle θ between the magnetic field vectors located in the ionisation zone and between this ionisation zone and the entry of the confinement zone, must remain less than 30°. It will be noted that it is possible to reduce the Larmor radius of the ion of interest by having a high magnetic field modulus in the ionisation zone 10: soft-iron cone 6 makes it possible to concentrate the magnetic field in this zone.

The two permanent magnets 4 and 5 are used to generate the magnetic field with a symmetry of revolution.

Second stage 8 thus forms an ECR magnetic confinement zone: magnets 4 and 5 are selected such that the vector sum of the magnetic fields created at each point of second stage 8 leads to the procurement of a closed line profile of minima |B|. Reference 16 in FIG. 1 denotes an equimodulus surface |Bf| (maximum modulus of the magnetic field in second stage 8), whereas reference 17 denotes ellipsoids of revolution defined by lower values of the magnetic field. Closed lines of minima are defined inside these ellipsoids 17. The maximum functioning frequency of second stage 8 is defined by closed surface 16 of maximum field modulus |Bf|. Such a configuration is described in patent EP946961 filed by the applicant. By way of illustration, the ECR confinement stage typically functions with a wave of frequency 2.45 GHz corresponding to closed line 11 represented in FIG. 1 (corresponding to a magnetic field modulus approximately equal to 870 G). The high-frequency wave at 2.45 GHz is injected via a waveguide (not represented) inserted into tube neck 18. The ions coming from ionisation zone 10 belonging to first stage 7 are confined in confinement zone 8, then are extracted in so-called extraction zone 9. It will be noted that ECR confinement zone 8 makes it possible not only to ensure the function of confining the charged ions during their passage in ionisation zone 10, but also, according to the sought aims, to preserve or increase the state of charge of the ions coming from the first stage. The second stage can also permit the creation of mono-charged ions (in particular in the case of the recombination of some atoms within confinement zone 8). Ion extraction zone 9 is located at the end opposite that in which first ionisation stage 7 is located, the magnetic field being approximately parallel to longitudinal axis AA' in this extraction zone 9: as soon as an electron leaves confinement zone 8 (it preferentially leaves this zone in extraction zone 9 in which the magnetic field is coaxial with longitudinal axis of symmetry AA'), there is an ion which will follow the electron and leave the confinement zone in such a way as to observe the neutrality of the plasma.

It will be noted that first and second stages 7 and 8 comprise one and the same continuous plasma.

It will also be noted that it is possible to use a single waveguide to inject the two high-frequency waves (for example a first frequency for first ionisation stage 7 equal to 18 GHz and a second frequency for the second confinement stage equal to 8 GHz transmitted by the same waveguide).

It is also possible to use a support gas (injected via a capillary (not shown) into chamber 2), which allows the electron population to be increased. This support gas is preferably a gas whose atoms have a lower mass than those permitting the ions of interest to be obtained. Thus, in the case of the ionisation of $^{208}Pb$, it is possible to use a support gas, for example He.

Waveguide system 13 and neutral element injection system 14 are of course connected in a perfectly tight manner to chamber 2 by means of suitable joints (not represented).

Moreover, the injection of the neutral elements into the ionisation zone has been more particularly described in the case of the use of a micro-furnace for condensable elements; the invention is of course also applicable to other known sources for producing neutral elements (gas bottle for example).

With a device such as is represented in FIGS. 1 and 2, two spectra of different ions are given in FIG. 3, according to whether the first ionisation stage does not function (curve with continuous bold line) or does function (curve with discontinuous bold line). These spectra give the intensity, expressed in microamperes, of ionic current I leaving the device as a function of the current in the analysis magnet, expressed in amperes; this analysis current gives the ratio Q/A where Q is the charge of the ion and A its mass. The spectra have been obtained in the case of the ionisation of $^{208}Pb$ with a micro-furnace power equal to 3.75 W, a frequency of the first stage equal to 9.347 GHz and a frequency of the second stage equal to 2.45 GHz. FIG. 3 clearly shows a gain in the ionisation efficiency depending on whether the first stage is functioning or not. Thus, a gain is observed (ratio of the ionic currents between the spectrum with functioning of the first stage and the spectrum without functioning of the first stage) equal to 3.1 for the ion $^{208}Pb^{3+}$ and 2.7 for the ion $^{208}Pb^{2+}$. An efficiency gain for the ions $^{208}Pb^{4+}$ and $^{208}Pb^{1+}$ is also observed.

FIG. 4 shows the trend in the intensities of $^{208}Pb$ with the variation in the power of the micro-furnace. The higher the power of the micro-furnace, the greater the ionisation. Overall, a direct gain in the overall intensity of $^{208}Pb$ (in particles) is noted, proceeding from a gain of 1.4 (for a power of the micro-furnace of 3.36 W) to 2.2 (for a power of the micro-furnace of 5.37 W).

It will be noted, moreover, that a functioning test (not represented) of the first stage alone (without causing the ECR confinement stage to function) reveals a very low production of ions.

The magnetic field in the example illustrated in FIGS. 1 and 2 is created by a system of permanent magnets. However, in order to obtain magnetic fields corresponding to higher ECR functioning frequencies, the use of a coil system is also possible. Thus, FIG. 5 illustrates a simplified schematic representation of a device 100 according to a second embodiment of the invention, including a chart of intensities of the modulus, equimodulus lines and vectors of the electromagnetic field prevailing in the device according to the invention.

Device 100 comprises:

a vacuum-tight chamber 102 having a longitudinal axis of symmetry AA';

two permanent magnets 104 and 105 essentially identical, having an annular shape and being disposed beside one another in such a way that their axis of revolution essentially coincides with longitudinal axis AA' of chamber 102;

a coil 101 through which a current of given intensity passes, the axis of revolution of said coil approximately coinciding with longitudinal axis AA' of chamber 102;

a soft-metal conical element 106 disposed in such a way that its narrowed cross-sectional end is located inside coil 101.

As for FIG. 1, FIG. 5 also includes a chart of the intensity of the moduli, equimodulus lines and vectors of the electromagnetic field prevailing in device 100 according to the invention.

Thus, the intensity of the magnetic field modulus is represented by dots: the denser the dots, the more intense the modulus prevailing in chamber 102.

Similarly, several equimodulus surfaces are represented in FIG. 5 by continuous lines.

Finally, the magnetic field vectors are represented by arrows.

Device 100 comprises:

a first ionisation stage 107 located at one end of chamber 102, first stage 7 comprising an ionisation zone 110;

a second magnetic confinement stage 108 for the ions generated by first stage 7;

a ion migration zone 112 from first stage 107 towards second stage 108;

an ion extraction zone 109.

Here, ionisation zone 110 is an ECR zone with a higher frequency than the ECR zone of FIG. 1 produced by means of coil 101. This ECR zone 110 is typically a high-density zone with a resonance zone functioning at 29 GHz. As for FIG. 1, this is a zone provided solely for the ionisation of the injected neutral particles and not for the confinement of these same ionised particles. This resonance frequency at 29 GHz implies the presence of a very high magnetic field in order to ensure the phenomenon of resonance that will permit the efficient ionisation of the neutral particles (acquisition of mono-charged and multi-charged ions). Soft-iron conical element 106 makes it possible locally to increase the value of the magnetic field modulus in order to obtain the resonance magnetic field in ionisation zone 110.

Apart from the sole difference of coil 101, which makes it possible to use an ECR zone of higher frequency for the ionisation stage, device 100 of FIG. 5 is identical to device 1 of FIG. 1 and functions in a similar manner.

The various embodiments described hitherto (FIGS. 1 and 2 and FIG. 5) all comprise a first ECR stage. It is however important to note that the device according to the invention can function with other types of ion sources, the only condition being that the ions are produced in a zone where the magnetic field is coaxial with the longitudinal axis of symmetry of the chamber, in such a way that the created ions migrate spontaneously towards the second confinement stage.

Thus, in place of a first ECR stage, the first ionisation stage can also be selected among the following sources:

discharge source, surface ionisation source, thermal ionisation source,

Laser source, field ionisation source, charge exchange source,

By way of illustration, FIGS. 6 and 7 illustrate a simplified schematic representation of devices 200 and 300 respectively according to a third and fourth embodiment of the invention including a chart of intensities of the modulus, equimodulus lines and vectors of the electromagnetic field prevailing in the device according to the invention.

Devices 200 and 300 are identical to device 1 of the figure with the difference that the first ionisation stage is not an ECR stage. We have retained the same references for the elements in common with device 1 of FIG. 1.

Device 200 of FIG. 6 differs from device 1 of FIG. 1 solely in that ionisation source 201 is a surface ionisation source, ionisation stage 207 of device 200 not therefore being an ECR device. The end of source 201 is located in zone forming the ionisation zone of device 200 in which the magnetic field is coaxial with longitudinal axis AA' of chamber 2 of device 200. It can be seen that permanent magnet 3 and soft-iron cone 6 have been retained in order to obtain a concentration of the magnetic field modulus in ionisation zone 10: this field concentration makes it possible to have ions with smaller Larmor radii and is particularly useful for heavy particles.

Device 300 of FIG. 7 differs from device 1 of FIG. 1 solely in that ionisation source 301 is a Laser excitation and ionisation source (one of the principles whereof is that of a focused Laser light beam which heats a target in a pointwise manner: the thermal expansion creates locally a shockwave which ejects a very hot and dense plasma "plume"; another principle is a laser resonant ionisation source permitting a peripheral electron to be removed), ionisation stage 307 of device 300 not therefore being an ECR device. The end of source 301 is located in zone 10 forming the ionisation zone of device 300 in which the magnetic field is coaxial with longitudinal axis AA' of chamber 2 of device 300. Once again, it can be seen that permanent magnet 3 and soft-iron cone 6 are retained in order to obtain a concentration of the magnetic field modulus in ionisation zone 10.

The invention claimed is:

1. An electron cyclotron resonance ion generator comprising:

a vacuum-tight chamber configured to contain a plasma, said chamber having an axial symmetry along a longitudinal axis, a magnetic field generator configured to generate a magnetic field in said chamber, said magnetic field having a symmetry of revolution with respect to said longitudinal axis, a waveguide configured to propagate a high-frequency wave inside said chamber, a first ionisation stage located at one end of said chamber, said first stage comprising an ionisation zone in which ions are generated, said magnetic field being approximately parallel to said longitudinal axis in said ionisation zone, a second magnetic confinement stage for said ions generated in said ionisation zone, said second stage using a first high-frequency wave being propagated in said chamber from said waveguide, said magnetic field being approximately parallel to said longitudinal axis between said ionisation zone and said second confinement stage, such that the ions generated in said ionisation zone migrate towards said second confinement stage and that said first and second stages contain the same continuous plasma.

2. The generator according to claim 1, wherein said first ionisation stage is an electron cyclotron resonance ion source.

3. The generator according to claim 2, comprising a waveguide configured to inject a second high high-frequency wave into said ionisation zone.

4. The generator according to claim 2, comprising an injection system configured to inject the elements to be ionised disposed in the vicinity of the resonance zone forming said ionisation zone of said cyclotron resonance ion source, said system remaining outside said resonance zone.

5. The generator according to claim 4, wherein said injection system includes a furnace configured to inject the vapour of condensable elements to be ionised into said resonance zone.

6. The generator according to claim 5, wherein said furnace is disposed approximately parallel to said longitudinal axis.

7. The generator according to claim 1, wherein said first ionisation stage is selected from the group consisting of the following sources:

discharge source, surface ionisation source, thermal ionisation source,

Laser source, field ionisation source, and charge exchange source.

8. The generator according to claim 1 comprising a system configured to locally increase the modulus of the magnetic field in said ionisation zone.

9. The generator according to claim 8, wherein said system configured to locally increase the modulus of the magnetic field includes a soft-iron ring.

10. The generator according to claim 1, wherein said magnetic field generator in said chamber comprises permanent magnets, wherein an axis of revolution of said permanent magnets essentially coincides with said longitudinal axis.

11. The generator according to claim 1, wherein said magnetic field generator in said chamber comprises at least one coil through which, in use, a current of given intensity runs.

12. The generator according to claim 1, further comprising an extraction zone of said ions located at the opposite end to that in which said first ionisation stage is located, said magnetic field being approximately parallel to said longitudinal axis in said extraction zone.

13. The generator according to claim 1, wherein said magnetic field generator in said chamber is configured to define in said second magnetic confinement stage at least one closed line of minima of said magnetic field, inside one or more volume(s) inside said chamber and delimited by equimodulus surfaces of the magnetic field which are closed in space.

* * * * *